US005335832A

United States Patent [19]

de Laforcade

[11] Patent Number: 5,335,832

[45] Date of Patent: Aug. 9, 1994

[54] DEVICE FOR ACTIVATING A DISPENSING MECHANISM SUCH AS A PUMP OR A VALVE

[75] Inventor: Vincent de Laforcade, Clamart, France

[73] Assignee: L'Oreal, Paris, France

[21] Appl. No.: 18,246

[22] Filed: Feb. 16, 1993

[30] Foreign Application Priority Data

Feb. 14, 1992 [FR] France ..... 92 01696

[51] Int. Cl.[5] ..... B65D 83/20

[52] U.S. Cl. ..... 222/402.13; 222/402.21; 222/402.24

[58] Field of Search ..... 222/182, 402.1, 402.13, 222/402.21, 402.24; 239/573, 579

[56] References Cited

U.S. PATENT DOCUMENTS

| | | | |
|---|---|---|---|
| 3,149,761 | 9/1964 | Harris et al. | 222/402.13 X |
| 3,404,814 | 10/1968 | Wakeman | 222/402.13 |
| 3,760,988 | 9/1973 | Ostrowsky | 222/182 X |
| 3,936,000 | 2/1976 | Weyn | 239/288.5 |
| 3,946,911 | 3/1976 | Morane et al. | 222/402.11 |
| 4,420,099 | 12/1983 | Pizzurro et al. | 222/205 |
| 5,139,180 | 8/1992 | Lucas | 222/402.13 |

FOREIGN PATENT DOCUMENTS

| | | |
|---|---|---|
| 0385863 | 9/1990 | European Pat. Off. . |
| 0455552 | 11/1991 | European Pat. Off. . |
| 2255787 | 7/1975 | France . |
| 2661661 | 11/1991 | France . |

*Primary Examiner*—Andres Kashnikow
*Assistant Examiner*—Joseph A. Kaufman
*Attorney, Agent, or Firm*—Oliff & Berridge

[57] ABSTRACT

A device for activating a dispensing mechanism such as a pump or a valve is fitted to a container that contains a product to be dispensed and has an axially movable push-type tubular control rod aligned with a dispensing orifice. The activating device has a pushbutton mounted at the end of the control rod of the dispensing mechanism and is provided with an outlet nozzle located essentially at the center of its outer face aligned and in communication with the control rod. The activating device also includes a substantially cylindrical operating part having an annular upper surface constituting a force application zone and a support member able to cooperate with a stop member such that application of an activation force at any point on the upper annular surface of the operating part triggers displacement of the pushbutton and the control rod to activate the dispensing mechanism. The operating part is connected to the push-button by a ball joint to transmit axial displacement resulting from an application of force on the force application zone to activate the control rod.

6 Claims, 1 Drawing Sheet

DEVICE FOR ACTIVATING A DISPENSING MECHANISM SUCH AS A PUMP OR A VALVE

TECHNICAL FIELD

The present invention relates to a device for activating a dispensing mechanism such as a pump or a valve, fitted to a container that contains a product to be dispensed, said dispensing mechanism having an axially movable push-type tubular control rod provided with a dispensing orifice.

More specifically, the invention relates to an activating device comprising a pushbutton mounted at the end of the control rod of the dispensing mechanism and provided with an outlet nozzle located essentially at the center of its outer face, aligned and in communication with the control rod, and a substantially cylindrical operating part having an annular upper surface constituting a force application zone, and a support member able to cooperate with a stop member such that application of an activation force at any point on said upper annular surface of the operating part triggers displacement of the pushbutton and the control rod to activate the dispensing mechanism.

BACKGROUND

An activating device of this type for a dispensing valve, particularly of a pressurized aerosol, is described in the embodiment shown in FIGS. 5 and 6 of French Patent No. FR-A-2,661,661 issued to the Assignee of the present application.

In this embodiment of the prior invention, the pushbutton is a nipple formed integrally with the operating part. Under the effect of application of a force to the annular upper surface of the operating part, and because of the contact between the support member of the operating part and the stop member, the operating part acts like a lever to depress the pushbutton and hence the control rod of the dispensing mechanism on which it is mounted.

Because the pushbutton is integral with the operating part, the pivoting movement of the operating part, caused by activation, also brings about a pivoting movement of the pushbutton which is depressed while inclined relative to the axis of the control rod of the dispensing mechanism.

Non-axial forces are thus applied to the control rod of the activating mechanism, which forces may cause the rod to break following repeated activation.

Moreover, because of the inclination of the pushbutton, the nozzle of the pushbutton is no longer in axial alignment with the rod of the dispensing mechanism, so that the product exiting the nozzle is not sprayed in the direction of the longitudinal axis of the container.

In addition, because a significant part of the force applied to the operating part does not contribute to the axial force exerted on the rod of the dispensing mechanism, the axial travel thereof is relatively short, and is insufficient to actuate the dispensing mechanism when the latter is in the form of a pump.

Another example of a similar prior art device is shown in FIGS. 4 and 5 of the present application in which a pushbutton 6' is joined to or made integral with an operating part 10'. As seen clearly in FIG. 5, the device is in the activating position and pushbutton 6' is inclined relative to rod 3'. The resulting jet spray is no longer oriented with the longitudinal axis of the rod and the travel of rod 3' is shorter.

SUMMARY OF THE INVENTION

A goal of the present invention is to create an activating device which avoids the disadvantages referred to above while having the advantages of the device disclosed in French Patent No. FR-A-2,661,661 including the capability of activation with a small force applied by any of the user's fingers at any point in a force application zone which extends 360° about the nozzle orifice.

The activating device according to the present invention is essentially characterized by the fact that the operating part is connected to the pushbutton by a ball joint.

In a preferred embodiment, the pushbutton has an upper hemispherical part at the top of which the outlet nozzle is provided. The operating part has an open central chamber defined by a wall with a spherical shape in which the hemispherical part of the pushbutton is engaged. The hemispherical part has a shape matching that of the open central chamber and is rotatable relative thereto.

Preferably, the operating part has an inner cylindrical sleeve in which the chamber is formed and an outer cylindrical sleeve. The inner and outer sleeves are coaxial and connected rigidly to each other, preferably by a continuous web with a frustoconical shape.

Preferably, the annular upper surface forming a force application zone is made in the form of a peripheral collar outside the upper end of the outer sleeve.

The outer sleeve advantageously has, at its lower end, a second outer peripheral collar which abuts an inner peripheral collar at the upper end of a cylindrical jacket mounted at the upper end of the container and accommodating the dispensing mechanism.

To the degree that, according to the invention, the pushbutton constitutes a separate part of the operating part and undergoes no pivoting movement when this part is activated, the pushbutton may advantageously be joined to the end of the control rod of the dispensing mechanism, for example by force-fitting. This ensures an excellent seal to keep the product from getting between the rod and the pushbutton outlet nozzle.

DETAILED DESCRIPTION OF A PREFERRED EMBODIMENT

Figure 1:
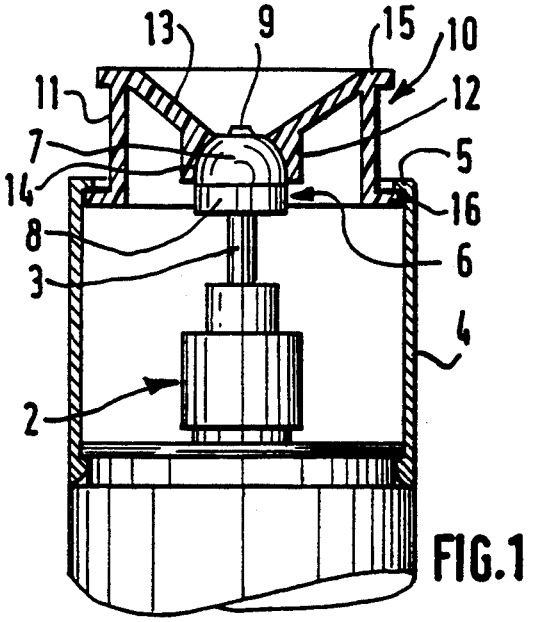
FIG. 1 is a schematic view partially in cross section of a device according to the present invention in the resting position.
Figure 2:
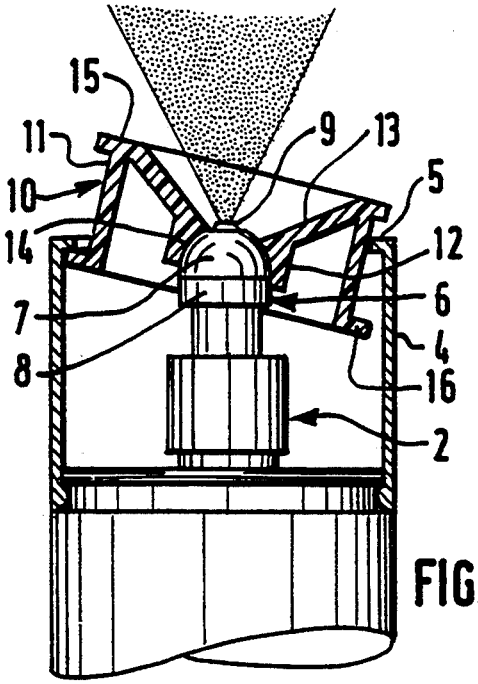
FIG. 2 is a view similar to FIG. 1 of the device in the activating position.
Figure 3:
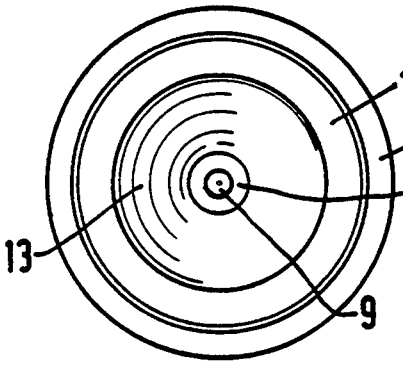
FIG. 3 is a top view of the device in the position of FIG. 1.
Figure 4:
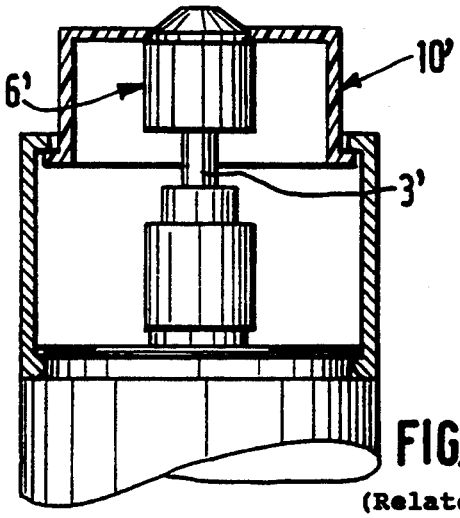
FIG.4 (Related Art)
FIGS. 4 and 5 are views similar to FIGS. 1 and 2, respectively of a device corresponding to the prior art.
Figure 5:
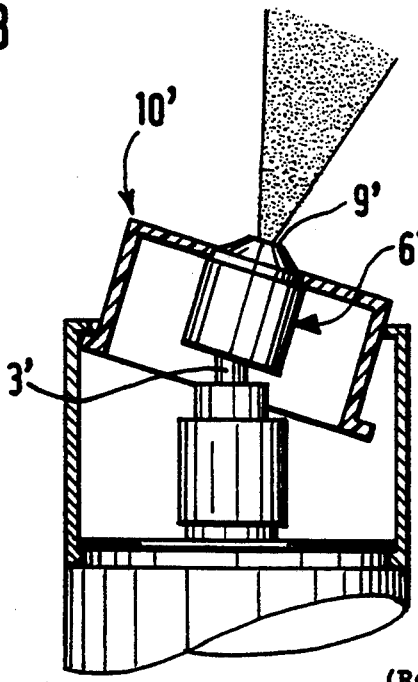
FIG.5 (Related Art)

Illustrated in FIGS. 1–3 in fragmentary fashion are a container 1 containing a product to be dispensed and provided at its upper part with a dispensing mechanism 2 which can be a valve, particularly when the product to be dispensed is a pressurized aerosol, or may be a pump to dispense a product particularly in the spray or foam form. Dispensing mechanism 2 is provided with an axially movable push-type tubular control rod 3 which is provided at its end with a dispensing orifice. A cylindrical jacket 4 provided at its upper end with an inner peripheral collar 5 is attached, by snap-fitting for example, to the upper end of the container.

A pushbutton 6 is located at the upper end of rod 3 and has an upper hemispherical part 7 and a lower cylindrical part 8. At the top of upper hemispherical part 7 of the pushbutton, a dispensing nozzle 9 is provided which communicates with the upper end of rod 3. Pushbutton 6 is hollow so that it can be fitted onto the end of rod 3. Advantageously, the hollow in pushbutton 6 is made to allow force-fitting of the rod onto the pushbutton, enabling these elements to be joined and ensuring an excellent seal against the product being dispensed.

The device according to this embodiment has an operating part designated generally by 10, preferably made as one molded plastic part and having an outer sleeve 11 and an inner sleeve 12 which are coaxial, inner sleeve 12 being shorter than outer sleeve 11 and being connected thereto by a continuous web with a frustoconical shape 13. Alternatively, the web may be composed of separate fingers arranged to produce a rigid connection between inner sleeve 12 and outer sleeve 11. A chamber is provided inside sleeve 12 for rotational reception of the upper hemispherical part 7 of pushbutton 6. This open chamber is defined by a wall 14 with a spherical shape of sleeve 12. The diameter of the hemispherical part of pushbutton 6 and that of the operating part at central sleeve 12 and web 13 are chosen such that, for any position of the operating part, the outlet orifice of nozzle 9 is clear.

Outer sleeve 11 of operating part 10 has an outer peripheral collar 15 at its upper end and another outer peripheral collar 16 at its lower end. Upper collar 15 constitutes an annular force application zone for activation of the device, and collar 16, in cooperation with collar 5 of jacket 4, constitutes support and stop means forming a fulcrum diametrically opposite the point to which a depressing force is applied to the upper face of collar 15, as in FIG. 2.

Under the influence of the force applied, the operating part pivots and, because of its ball joint connection at sleeve 12 with pushbutton 6, transmits to the pushbutton an axial displacement movement of a substantial amplitude which correspondingly moves rod 3 of dispensing mechanism 2. It can be seen from FIG. 2 that the jet thus sprayed through nozzle 9 has an axis aligned with the longitudinal axis of the rod and the container.

The device according to this embodiment illustrated in FIGS. 1 to 3 may be assembled as follows. Pushbutton 6 is set in place at the end of rod 3 of the dispensing mechanism mounted on container 1. Operating part 10 is engaged in cylindrical jacket 4 before jacket 4 is mounted on the container. For this purpose, it is important for the outside diameter of upper collar 15 of the operating part to be slightly smaller than the inside diameter of collar 5 of jacket 4. Inner sleeve 12 of operating part 10 is then engaged on pushbutton 6 and jacket 4 is attached to the container.

Although the invention has been described in relation to a specific embodiment, it is obvious that it is not limited thereto and that various changes and variations may be made without thereby departing either from its framework or its spirit.

I claim:

1. A device for activating a dispensing mechanism fitted to a container that contains a product to be dispensed, said dispensing mechanism comprising:

an axially movable push-type tubular control rod provided with a dispensing orifice;

a pushbutton being mounted at an end of the control rod and provided with an outlet nozzle located substantially at a center of an outer face of said pushbutton, said outlet nozzle being aligned and in communication with said rod;

a substantially cylindrical operating part having an annular upper surface constituting an annular force application zone and a support member annularly pivotably supporting said operating part;

a stop member engageable with said support member; and a ball joint connecting said operating part to said push button;

wherein said support member is formed to cooperate with said stop member such that application of an activation force at any point on said upper annular surface of the operating part triggers displacement of the pushbutton and the control rod to activate the dispensing mechanism.

2. The device according to claim 1, wherein said pushbutton has an upper hemispherical part, said outlet nozzle being provided at the top of said hemispherical part, said operating part including an open central chamber defined by a wall having a spherical shape; said hemispherical part of the pushbutton having a shape matching the shape of said wall of the operating part; said hemispherical part being connected to said wall of the operating part and being rotatable relative thereto.

3. The device according to claim 2, further comprising a continuous web having a frustoconical shape, said operating part having an inner cylindrical sleeve and an outer cylindrical sleeve; said open central chamber being formed in said inner cylindrical sleeve, said inner and outer sleeves being coaxial and rigidly connected to each other by said continuous web.

4. The device according to claim 3, wherein the upper annular surface of the operating part comprises an outer peripheral collar located at an upper end of said outer sleeve.

5. The device according to claim 1, wherein said pushbutton is connected to said control rod by force-fitting.

6. A device for activating a dispensing mechanism fitted to a container that contains a produce to be dispensed, said dispensing mechanism comprising:

an axially movable push-type tubular control rod provided with a dispensing orifice;

a pushbutton mounted at an end of the control rod and provided with an outlet nozzle located substantially at a center of an outer face of said pushbutton, said outlet nozzle being aligned and in communication with said rod, said pushbutton having a hemispherical part, wherein said outlet nozzle is provided at the top of said hemispherical part;

a substantially cylindrical operating part having an annular upper surface constituting a force application zone and a support member annularly pivotably supporting said operating part, said operating part including an open central chamber defined by a wall having a spherical shape, wherein said hemispherical part of the pushbutton has a shape matching the shape of said wall of the operating part, said hemispherical part being connected to said wall of the operating part and being rotatable relative thereto, said operating part further comprising an inner cylindrical sleeve and an outer cylindrical sleeve, wherein said open central chamber is formed in said inner cylindrical sleeve and wherein said inner and outer sleeve are coaxial and rigidly connected to each other by a continuous web having a frustoconical shape;

a stop member engageable with said support member;

a ball joint connecting said operating part to said pushbutton; and a cylindrical jacket surrounding said dispensing mechanism and having an inner peripheral collar, said cylindrical jacket being mounted at an upper end of the container, a lower end of said outer sleeve having a second outer peripheral collar positioned so as to abut said inner peripheral collar of the cylindrical jacket;

wherein said support member is formed to cooperate with said stop member such that application of an activation force at any point on said upper annular surface of the operating part triggers displacement of the pushbutton and the control rod to activate the dispensing mechanism.

* * * * *